US005442836A

United States Patent [19]

Fehrer

[11] Patent Number: 5,442,836

[45] Date of Patent: Aug. 22, 1995

[54] APPARATUS FOR MAKING A NONWOVEN WEB BY SUCKING FIBERS FROM A CARDING DRUM ONTO A MOVING FIBER COLLECTING SURFACE

[76] Inventor: Ernst Fehrer, Auf der Gugl 28, A-4020 Linz, Austria

[21] Appl. No.: 255,645

[22] Filed: Jun. 8, 1994

[30] Foreign Application Priority Data

Jun. 18, 1993 [AT] Austria ..... 1198/93
Dec. 10, 1993 [AT] Austria ..... 2491/93

[51] Int. Cl.[6] ..... D01G 25/00
[52] U.S. Cl. ..... 19/304; 19/99; 19/296; 406/70
[58] Field of Search ..... 19/99, 106 R, 161.1, 19/296, 148, 302, 304, 305, 308; 264/517, 121; 406/69, 70, 78, 82, 93, 94

[56] References Cited

U.S. PATENT DOCUMENTS 3,768,118 10/1973 Ruffo et al. ..... 19/302 X
4,345,356 8/1982 Handscuch et al. ..... 19/304 X
4,583,267 4/1986 Fehrer ..... 19/99
4,972,551 11/1990 Fehrer ..... 19/99
5,007,137 4/1991 Fehrer ..... 19/296
5,117,535 6/1992 Fehrer ..... 19/99
5,289,618 3/1994 Fehrer ..... 19/304

FOREIGN PATENT DOCUMENTS

92/08833 5/1992 European Pat. Off. ..... 19/302

*Primary Examiner*—Clifford D. Crowder
*Assistant Examiner*—John J. Calvert
*Attorney, Agent, or Firm*—Collard & Roe

[57] ABSTRACT

An apparatus for making a nonwoven web comprises a carding drum and a continuously movable, air-permeable collecting surface member, which is arranged to collect the fibers which have been discharged from the carding drum and are entrained by an entraining air stream, through a suction duct, which extends between the carding drum and the collecting surface member. Passages for supplying air to the suction duct are provided throughout a predetermined working width of the drum and disposed adjacent to the duct at leading and trailing boundaries thereof with respect to the direction of rotation of the carding drum. To improve the uniform separation of fibers from the carding drum, it is proposed to arrange worker roller to cooperate with the carding drum adjacent to the leading boundary of the duct, and an air supply passage for supplying a stream of air to be sucked through the throat of the gap between the carding drum and the worker roller is provided between the worker roller and the carding drum and terminates on that side of the worker roller which is remote from the suction duct.

8 Claims, 1 Drawing Sheet

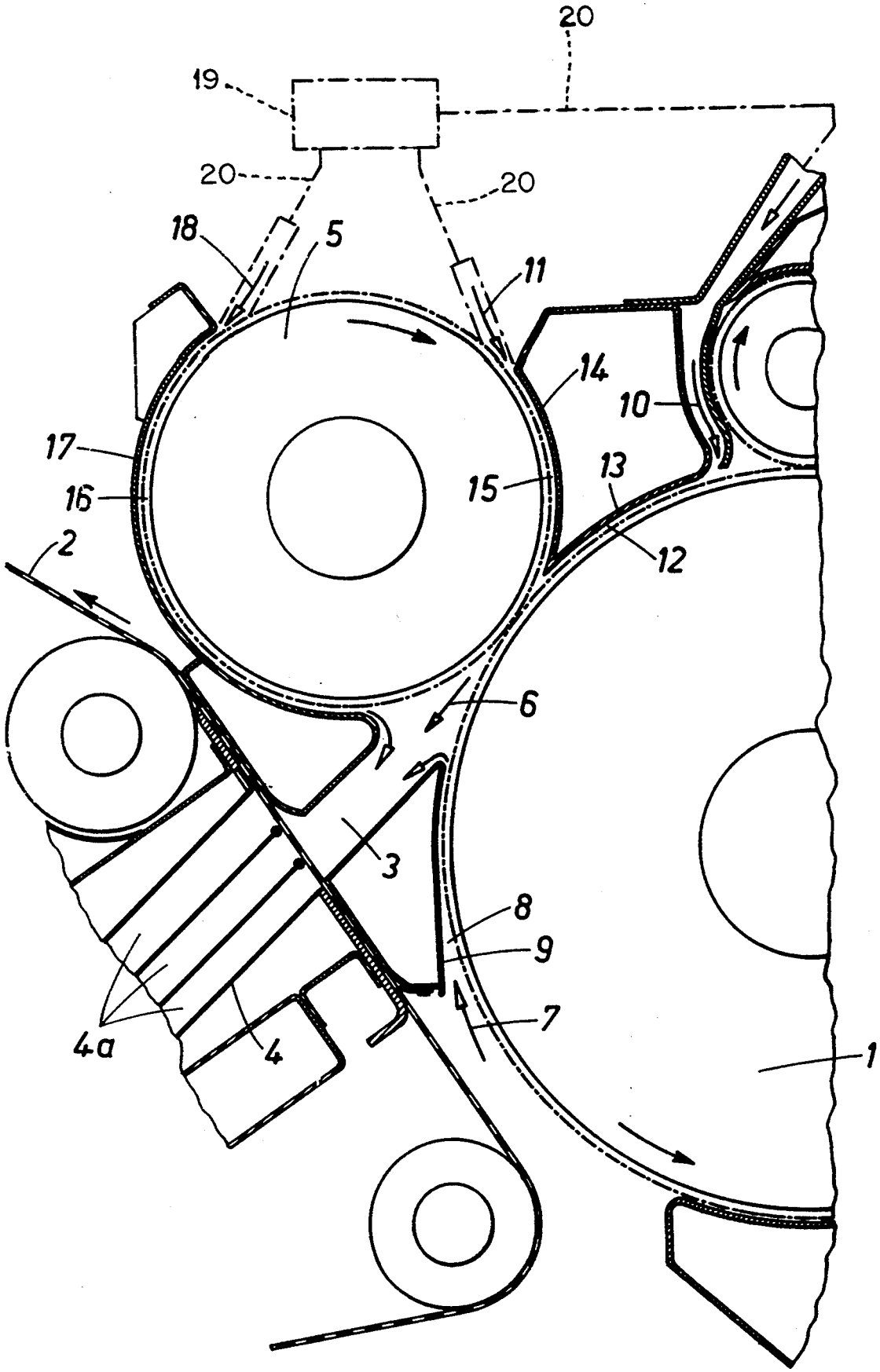
20
19
20
20
18
5
11
14
10
17
16
15
13
12
2
6
3
8
9
7
4a
4
1

APPARATUS FOR MAKING A NONWOVEN WEB BY SUCKING FIBERS FROM A CARDING DRUM ONTO A MOVING FIBER COLLECTING SURFACE

BACKGROUND OF THE INVENTION

1. Field of the Invention

This invention relates to an apparatus for making a nonwoven web, comprising a carding drum, a continuously movable, air-permeable collecting surface member, which is arranged to collect the fibers which have been discharged from the carding drum and are entrained by an entraining air stream, a suction box, which adjoins the collecting surface member on that side thereof which is opposite to the carding drum, and a suction duct, which extends between the carding drum and the collecting surface member and adjoins the carding drum at a peripheral portion thereof which is directly opposite to the collecting surface member, wherein air supply passages for supplying air to the suction duct are provided throughout a predetermined working width of said drum and disposed adjacent to said duct at leading and trailing boundary means thereof with respect to the sense of rotation of the carding drum.

2. Description of the Prior Art

Because in apparatuses of that kind the suction duct is disposed between the collecting surface member and a peripheral portion thereof which is directly opposite to the collecting surface member, the length of that suction duct and also the length of the flight path of the fibers can be selected as required in each case, independently of the diameter of the drum. As a result, the average length of the flight path of the fibers may be restricted to an extent which is smaller than the radius of the drum so that the risk of a formation of fiber lumps is greatly reduced. But that result cannot be achieved unless the singled fibers are uniformly detached from the carding drum and the fibers are conveyed within the suction duct without a disturbance. The conditions of flow within the suction duct may properly be influenced by the provision of air supply passages in the region in which the carding drum is adjoined by those boundary means of the suction duct which are the leading and trailing boundary means with respect to the direction of rotation of the carding drum. But the fibers may not sufficiently uniformly separate from the carding drum and in that case the fibers will not be uniformly deposited on the collecting surface member in spite of the existence of desirable 20 conditions of flow within the suction duct.

SUMMARY OF THE INVENTION

For this reason it is an object of the invention so to design an apparatus which is of the kind described first hereinbefore and serves to make a nonwoven web that a desirable separation of the fibers from the carding drum and, as a result, a uniform deposition of the fibers on the collecting surface member, can be ensured.

The object set forth is accomplished in accordance with the invention in that a worker roller is provided, which is arranged to cooperate with the carding drum adjacent to the leading boundary means of the duct, and an air supply passage for supplying a stream of air to be sucked through the throat of the gap between the carding drum and the worker roller is provided between said worker roller and the carding drum and terminates on that side of said worker roller which is remote from the suction duct.

Because an additional worker roller is provided on the leading side of the suction duct the uniformity of the layer of fibers on the carding drum is improved immediately before the fibers separate from the drum so that said fibers will be uniformly distributed as they enter the entraining air stream which is sucked through the suction duct and as they are supplied to the collecting surface member. The separation of the fibers from the carding drum is desirably assisted by the stream of air which is supplied through the throat of the gap between the carding drum and the worker roller and this results in particularly favorable conditions as regards the conveyance of fibers between the carding drum and the collecting surface member.

A particularly simple design will be achieved if the worker roller constitutes a portion of the leading boundary means of the duct because it will not be necessary to provide a separate duct wall on the leading side adjacent to the carding drum.

To promote a uniform separation of fibers from the carding drum, a further feature of the invention resides in that at least a branch passage of the air supply passage for supplying air to the throat of the gap between the carding drum and the worker roller is defined by the carding drum and a drum guard, which adjoins the worker roller and extends opposite to the direction of rotation of the drum. The drum guard precedes the worker roller in the direction of rotation of the drum and is radially spaced from the drum and permits the provision of an air supply passage for supplying in a stream which flows along the periphery of the carding drum through the throat of the gap between the carding drum and the worker roller so that an occurrence of disturbing components of flow, which would be transverse to the peripheral direction of the drum, will be avoided. As a result, the advantage which is afforded by the worker roller and resides in that the uniformity of the fibers covering the carding drum is improved immediately before the separation of the fibers will not adversely be affected by the flow conditions. The stream of air which is sucked through the throat of the gap between the carding drum and the worker roller need not entirely be supplied along the periphery of the carding drum but it will be sufficient to conduct a partial stream at a sufficiently high rate through the air supply passage between the carding drum and the drum guard which precedes the worker roller. The remaining air stream may desirably be conducted around the periphery of the worker roller on that side thereof which is opposite to the drum guard.

To prevent an entraining of fibers from the suction duct by the worker roller, a further feature of the invention resides in that an additional air supply passage is provided between the worker roller and a roller guard, which extends from the suction duct in the direction of rotation of the worker roller and is arranged to conduct air flowing opposite to the direction of rotation of the worker roller and to return into the suction duct any fibers which may have been entrained by the worker roller. That additional air stream will also prevent a contact of the leading wall of the suction duct by the fibers so that the tendency to form fiber lumps will be reduced.

The same purpose is served by an air supply passage which is defined on the trailing side of the suction duct by the carding drum and a drum guard and assists the separation of fibers from the carding drum. In order to ensure that the conditions of flow will be independent of the suction conditions in the suction duct at least adjacent to that air supply passage on the trailing side of the suction duct, that air supply duct may be connected to a fan for controlling the air flow through said air supply passage.

BRIEF DESCRIPTION OF THE DRAWING

The drawing is a fragmentary schematic sectional view showing by way of example that portion of an apparatus in accordance with the invention for making a nonwoven web which is disposed adjacent to the suction duct.

DETAILED DESCRIPTION OF THE PREFERRED EMBODIMENT

The apparatus in accordance with the invention for making a nonwoven web essentially comprises a carding drum 1, which is provided with a clothing of teeth, a continuously movable, air-permeable collecting surface member 2, and a suction duct 3, which extends between the collecting surface member 2 and a portion of the peripheral surface of the carding drum 1, which portion is directly opposite to the collecting surface member 2. The length of the suction duct 3 is smaller than the radius of the carding drum 1. A suction box 4 adjoins the collecting surface member 2 at a surface thereof which is opposite to the carding drum and said box 4 serves to suck entraining air from the suction duct 3 through the collecting surface member 2.

A preliminary nonwoven web is supplied in the conventional manner by means of a conveyor belt to a trough feeder, which precedes the carding drum 1 and consists of a trough table and a feed roller. These feeding means are not shown for the sake of clearness. In the predetermined direction of rotation of the carding drum 1 the trough feeder is succeeded by pairs of worker and stripper rollers, by which the uniformity of the layer of fibers on the carding drum 1 is improved. That layer of fibers is separated into individual fibers by the carding operation and is then conveyed to the suction duct 3 through the throat of the gap between an additional worker roller 5 and the carding drum 1.

The entraining air to be sucked through the suction duct 3 substantially consists of an air stream 6, which is conducted through the throat of the gap between the carding drum 1 and the worker roller 5, and of an air stream 7, which is conducted through the air supply passage 8 between the carding drum 1 and a drum guard 9, which adjoins the suction duct on its trailing side.

The air stream 6 is composed of two partial air streams 10 and 11, which are respectively conducted along the periphery of the carding drum and along the periphery of the worker roller 5. For that purpose an air supply passage 12 is provided between the carding drum 1 and a drum guard 13, which adjoins and extends from the worker roller 5 opposite to the direction of rotation of the drum and together with a wall portion 14 that is opposite to the worker roller 5 defines an air supply passage 15 for conducting the air stream 11. Because the partial streams 10 and 11 which are supplied to the throat of the gap between the worker roller 5 and the carding drum 1 along the periphery of the carding drum 1 and along the periphery of the worker roller 5 on that side thereof which is opposite to the drum guard 13 have tangential directions of flow, they ensure a desirable uniform separation of the fibers as an essential requirement for a uniform entraining of the fibers through the suction duct 3. To ensure that the fibers will completely be separated from the worker roller 5, an additional air supply passage 16 may be provided between the worker roller 5 and a roller guard 17, which extends from the suction duct 3 oppositely to the direction of rotation of the worker roller, which is opposite to that of the carding drum 1. The air 18 which is supplied through said air supply passage 16 opposite to the direction of rotation of the worker roller 5 will entrain back to the suction duct 3 any fibers which may have been entrained by the worker roller and provides additional forces for guiding the stream of fibers within the suction duct. A fan 19 may supply partial air streams 10, 11 and air stream 18 through ducts 20, as schematically indicated in phantom lines, to provide strong air streams.

Similarly, the air stream 7 conducted in the air supply passage 8 will assist the separation of fibers from the carding drum 1 and the deflection of said fibers into the direction of the suction duct 3. To make air available at a rate which is sufficient for that purpose, the air supply passage 8 may optionally be connected to a fan, which is not shown for the sake of clearness. Each of the air supply passages 12, 15, and 16 may also communicate with a fan.

To ensure a uniform deposition of the fibers which have been conducted through the suction duct 3 on the collecting surface of the collecting surface member 2, means must be provided for properly sucking off the entraining air stream, which is intercepted by the collecting surface member 2. For that purpose the distribution of the suction stream is controlled in that the suction box 4 is subdivided into separate suction box sections, which succeed each other in the direction of movement of the collecting surface member 2 and which may be subjected at least in groups to different negative pressures.

I claim:

1. An apparatus for making a nonwoven web, comprising (a) a carding drum having a peripheral surface and operable to rotate in a predetermined direction of rotation, (b) a continuously movable, air-permeable fiber collecting member spaced from a portion of the peripheral carding drum surface, the fiber collecting member having a fiber collecting surface facing the peripheral carding drum surface portion and another surface opposite the peripheral carding drum surface portion, (c) a suction duct leading from the peripheral carding drum surface portion to the fiber collecting surface, the suction duct being defined between (1) a boundary means leading with respect to the direction of rotation of the carding drum and (2) a boundary means trailing with respect to the direction of rotation of the carding drum, (d) a suction box adjoining the fiber collecting member at the other surface opposite the peripheral carding drum surface portion, (e) air supply passage means disposed adjacent the leading and trailing suction duct boundary means and extending throughout a predetermined working width of the carding drum, the air supply passage means receiving fiber entraining air streams passing through the air supply passage means into the suction duct, the air streams discharging fibers from the peripheral surface and entraining the discharged fibers into the suction duct, and (f) a worker roller operable to rotate in a direction of rotation opposite to the direction of rotation of the carding drum, (1) the worker roller and the carding drum defining therebetween a gap having a throat adjacent the leading suction duct boundary means, and (2) the air supply passage means adjacent the leading suction duct boundary means is disposed at a side of the throat remote from the suction duct and communicates with the throat, the air stream passing through the latter air supply passage means moving through the throat into the suction duct.

2. The apparatus of claim 1, further comprising a fan communicating with the air supply passage means adjacent the leading suction boundary means.

3. The apparatus of claim 1, further comprising a first drum guard adjoining the worker roller and extending in a direction opposite the direction of rotation of the carding drum, the first drum guard defining the air supply passage means adjacent the leading suction duct boundary means with the carding drum.

4. The apparatus of claim 1, further comprising a first drum guard adjoining the worker roller and extending in a direction opposite the direction of rotation of the carding drum, the first drum guard defining one branch of the air supply passage means adjacent the leading suction duct boundary means with the carding drum and a second branch, and a second branch of said air supply passage means being defined between the first drum guard and the worker roller.

5. The apparatus of claim 4, further comprising a fan communicating with both branches of said air supply passage means.

6. The apparatus of claim 6, further comprising a second drum guard extending from the trailing suction duct boundary means in the direction of rotation of the carding drum, the second drum guard defining the air supply passage means adjacent the trailing suction duct boundary means with the carding drum.

7. The apparatus of claim 1, further comprising a worker roller guard extending from the leading suction duct boundary means in the direction of rotation of the worker roller and defining therewith an additional air supply passage means.

8. The apparatus of claim 7, further comprising a fan communicating with the additional air supply passage means.

* * * * *